United States Patent [19]

Neipling et al.

[11] Patent Number: 4,630,675

[45] Date of Patent: Dec. 23, 1986

[54] DRILLING CHOKE PRESSURE LIMITING CONTROL SYSTEM

[75] Inventors: Lawrence E. Neipling, Long Beach; Mark C. Flohr, Irvine, both of Calif.

[73] Assignee: Smith International Inc., Newport Beach, Calif.

[21] Appl. No.: 737,942

[22] Filed: May 28, 1985

[51] Int. Cl.[4] ..... E21B 7/00

[52] U.S. Cl. ..... 166/53; 166/65.1; 175/25

[58] Field of Search ..... 166/53, 54, 65.1; 175/25, 38

[56] References Cited

U.S. PATENT DOCUMENTS

| | | | |
|---|---|---|---|
| 3,362,487 | 1/1968 | Lindsey | 175/38 |
| 3,372,761 | 3/1968 | Van Gils | 175/25 |
| 3,443,643 | 5/1969 | Jones | 175/25 |
| 3,677,353 | 7/1972 | Baker | 175/38 |
| 3,910,360 | 10/1975 | Sundstrom | 175/38 |
| 4,253,530 | 3/1981 | Sharki et al. | 175/38 |

OTHER PUBLICATIONS

Cameron Iron Works, "Drilling Choke Control System, 38933 Series Console" dated Jul. 1982, pp. 2-17 to 2-9 and 5-27 to 5-28.

*Primary Examiner*—Stephen J. Novosad
*Assistant Examiner*—William P. Neuder
*Attorney, Agent, or Firm*—Christie, Parker & Hale

[57] ABSTRACT

A pneumatic system is used for controlling the position of a hydraulically-actuated drilling choke to limit the maximum pressure in the casing of an oil well. Pressure in the casing is used directly to switch a converter valve that applies air pressure to the pressure limiting system. The air pressure opens the choke to relieve casing pressure. The system traps a volume of air at a pressure corresponding to the choke position and uses this pressure as a memory signal for resetting the choke to its preset position after casing pressure has decreased below its allowable maximum. The system also uses pneumatic pressure to assure that the memory is not lost before the choke is reset.

8 Claims, 6 Drawing Figures

Figure 1:
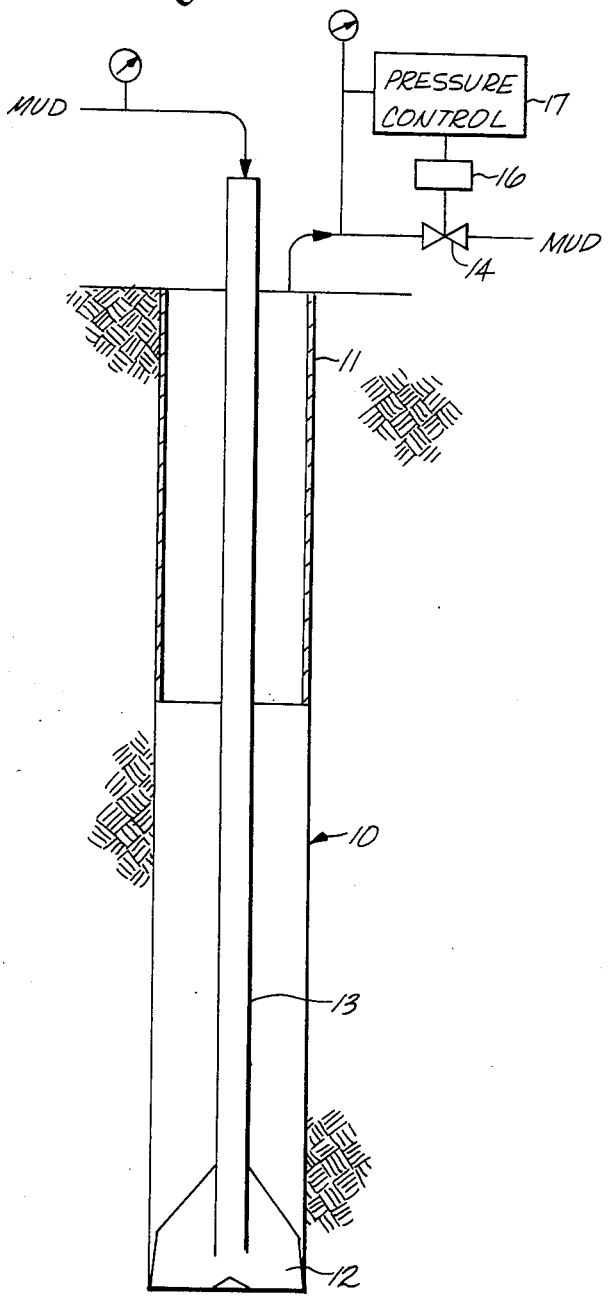

21
CASING PRESSURE
22
23
36
HYDRAULIC SUPPLY
37
HYDRAULIC VENT
34
38
TO OPEN CHOKE
39
TO CLOSE CHOKE
28
CHOKE POSITION SIGNAL
AIR
24
42
26
31
29
33
32
27
44
43
41

21
CASING PRESSURE
22
23
36
HYDRAULIC SUPPLY
37
HYDRAULIC VENT
34
38
TO OPEN CHOKE
39
TO CLOSE CHOKE
28
CHOKE POSITION SIGNAL
AIR
24
42
29
31
26
33
27
32
44
43
41

DRILLING CHOKE PRESSURE LIMITING CONTROL SYSTEM

BACKGROUND OF THE INVENTION

When drilling an oil well or the like, a steel casing is commonly set in concrete near the ground surface for containing drilling mud and production fluids, and maintaining well pressure as the well is completed. The well is drilled by rotating a drill bit on the end of a steel pipe or drill string that extends through the casing to the bottom of the hole being drilled. Drilling mud is pumped into the drill string at high pressure during drilling for a variety of purposes, including cooling the drill bit, carrying particles of the formation being drilled to the ground surface, and providing hydraulic head in the casing for controlling well pressure. The drilling mud circulated down the drill string returns in the annulus between the casing and drill string.

The drilling mud is discharged from the casing through an adjustable drilling choke or valve. The choke limits the discharge of mud, thereby maintaining a desired back pressure in the casing for well control. Such a drilling choke may, for example, be a high-pressure needle valve having a relatively small orifice through which the mud flows.

Sometimes chips of formation being drilled are too large to pass through the adjustable choke when it is partly closed for maintaining a set point pressure in the well. Such particles can partly plug the choke, causing pressure in the casing to rise. It is undesirable for the casing pressure to exceed a selected limit for a variety of reasons, such as, for example, blow-outs, damage to the well head, casing or related equipment, excessive back pressure on the mud pumps, and damage to the well formation itself.

Thus when the casing pressure rises, indicative of plugging the choke, it is desirable to rapidly open the choke to its fully open position, thereby relieving pressure and ordinarily clearing the choke of the obstructing debris. Since rapid response is required, an automatic rather than manual system is desirable. It is also important that after the casing pressure has dropped to a safe level that the drilling choke be closed to its original set point for continued drilling. Again, it is desirable that this be done automatically.

Cameron Iron Works of Houston, Tex., has provided a system for limiting the maximum allowable casing pressure during drilling. This is described in a document entitled "Drilling Choke Control System, 38933 Series Console" dated July 1982 at pages 2–17 through 2–29 and 5–27 to 5–28. The Cameron drilling choke control system employs pneumatic pressure for operating the choke actuator, using roughly 100 psig. air to drive the actuator. The high pressure in the choke manifold is converted to a low pressure analog pneumatic signal proportional to manifold pressure. The pneumatic signal is compared with a pneumatic set point for detecting an allowable maximum pressure for opening the choke if the set point pressure is exceeded. The pneumatic pressure used to operate the choke is also employed in the Cameron system to maintain memory of the original set point of the choke for restoring the choke to its original position when manifold pressure again drops below the maximum allowable pressure.

Such a pneumatic signal has several shortcomings. It is relatively insensitive to pressure changes so that the maximum allowable pressure is not closely controlled.

Quite often it is necessary to place the control system a substantial distance from the choke, and under these circumstances, there are pressure and time lags inherent in the system that can delay opening of the choke. There must be extensive recalibration of the system on a regular basis to maintain any semblance of control accuracy.

It is often desirable to employ a choke control system using hydraulic pressure at, for example, 1,500 psig. for actuating the choke. In addition to the superior reliability of a hydraulic system to a pneumatic system, the hydraulic system can provide substantially higher choke actuator torque and can employ considerably smaller components at the normally crowded site of the actuator. Further, in practice of this invention, there is provided direct sensing of the choke manifold pressure for switching a "digital" pneumatic pressure when a maximum allowable casing pressure is exceeded. By switching pneumatic pressure on or off in direct response to pressure in the drilling choke manifold, a significant source of error and time lag, the analog pneumatic signal, is eliminated. The switched pneumatic pressure not only controls hydraulic operation of the choke actuator, but also assures retention of the original actuator position set point for resetting the choke when casing pressure drops below the allowable maximum. By using the lower pressure pneumatic signal instead of the higher hydraulic actuator pressure, lower cost components can be used in the control system.

SUMMARY OF THE INVENTION

Thus an improved pressure limiting system for a drilling choke is provided in practice of this invention according to a presently preferred embodiment. The choke is hydraulically actuated by way of a pilot controlled three-way valve which applies hydraulic pressure to open the choke when opened in a first position and to close the choke when opened in a second position. The choke position is indicated by a pneumatic pressure signal which is connected to one side of a pneumatic comparator. A signal memory pneumatic accumulator is connected to the other side of the pneumatic comparator and can be alternately connected to the choke position indicating pressure signal or isolated from the signal by a memory latching valve. A pneumatic isolation accumulator is connected to the memory latching valve for selectively isolating the signal memory accumulator. A pilot operated choke reset valve has an inlet connected to the pneumatic comparator and an outlet connected to the three-way valve for biasing the three-way valve toward the choke closing position when the pressure in the signal memory pneumatic accumulator is higher than the choke position indicating pressure. The pressure limiting system is actuated by a hydraulic-pneumatic converter valve which compares the pressure in the casing of a well with a maximum pressure set point and generates a pneumatic pressure in the pressure limiting system when the casing pressure exceeds the maximum allowable. The pneumatic pressure is connected to the three-way valve for opening the choke and to the operator of the choke reset valve to prevent choke closing. A pilot controlled isolation latching valve alternately connects the isolation accumulator to the pneumatic pressure or isolates the accumulator from the pneumatic pressure. The pilot operator of the isolation latching valve is connected to the pneumatic comparator for isolating the isolation accumulator when pressure in the signal memory accumulator is higher than the pressure indicative of choke position. The three-way valve is closed and the system reset when the casing pressure decreases below the maximum pressure set point. For example, this reopens the memory latching valve for reconnecting the signal memory accumulator to the pressure indicative of choke position.

DRAWINGS

Figure 2:
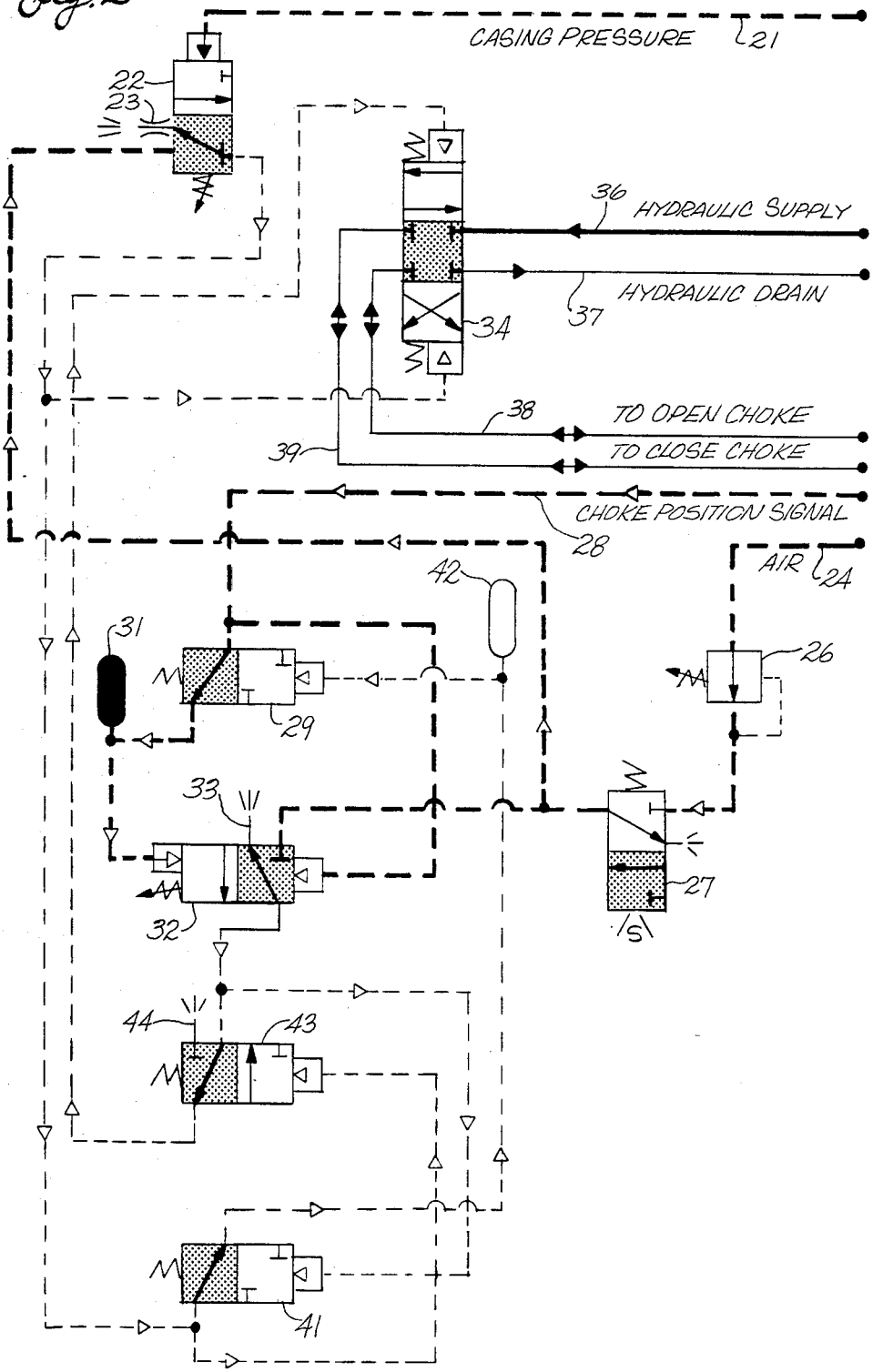
Figure 3:
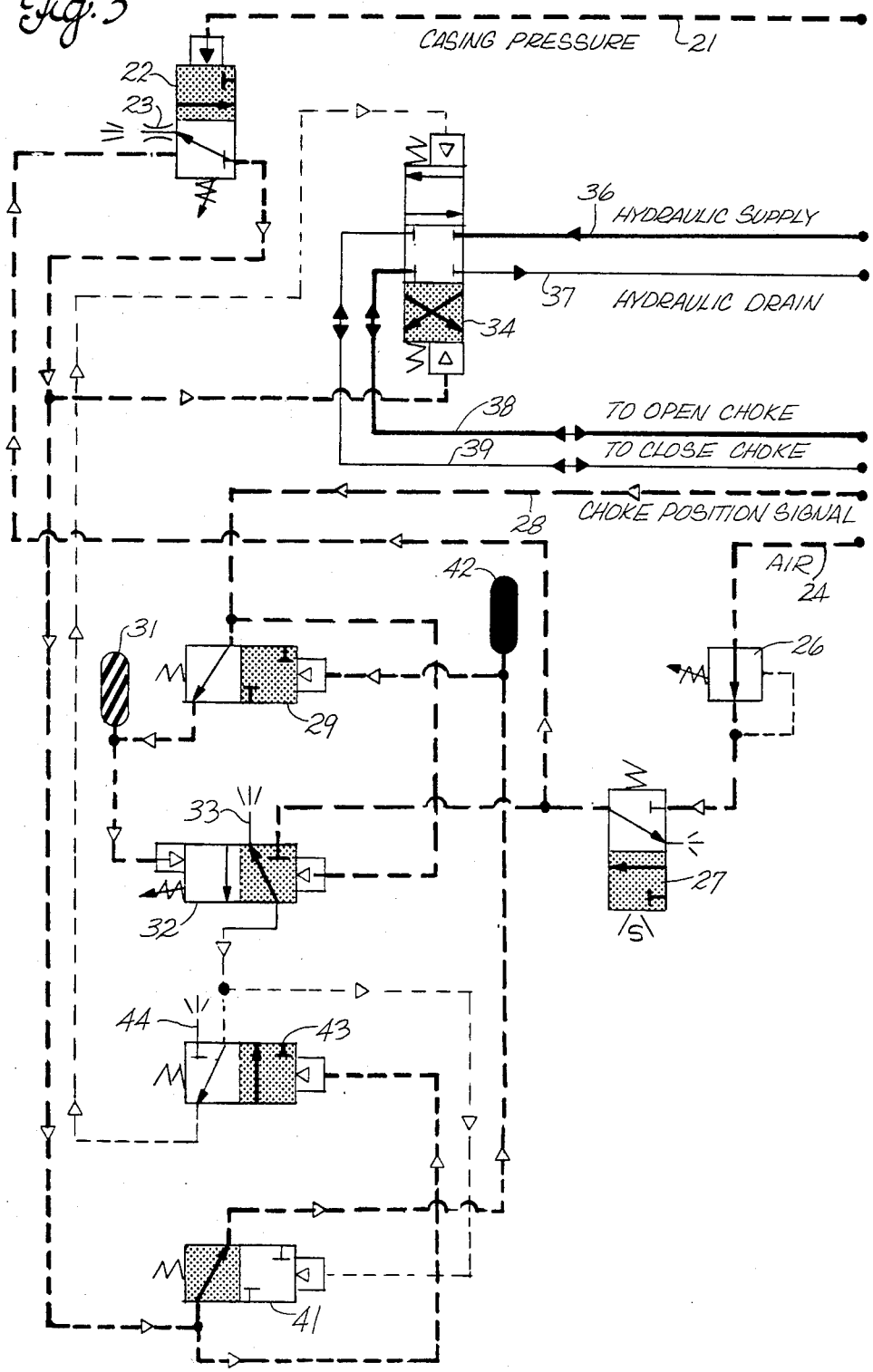
Figure 4:
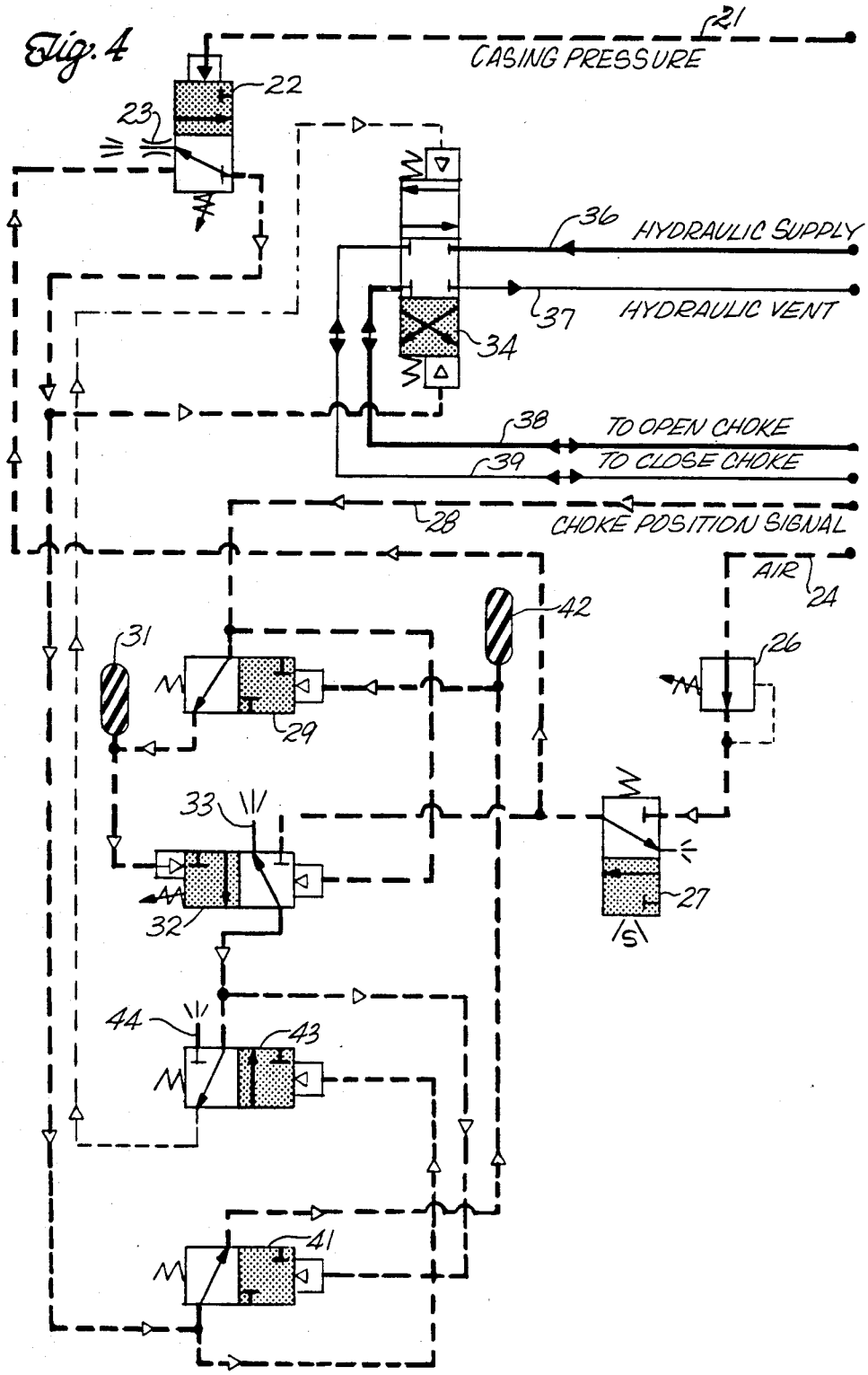
Figure 5:
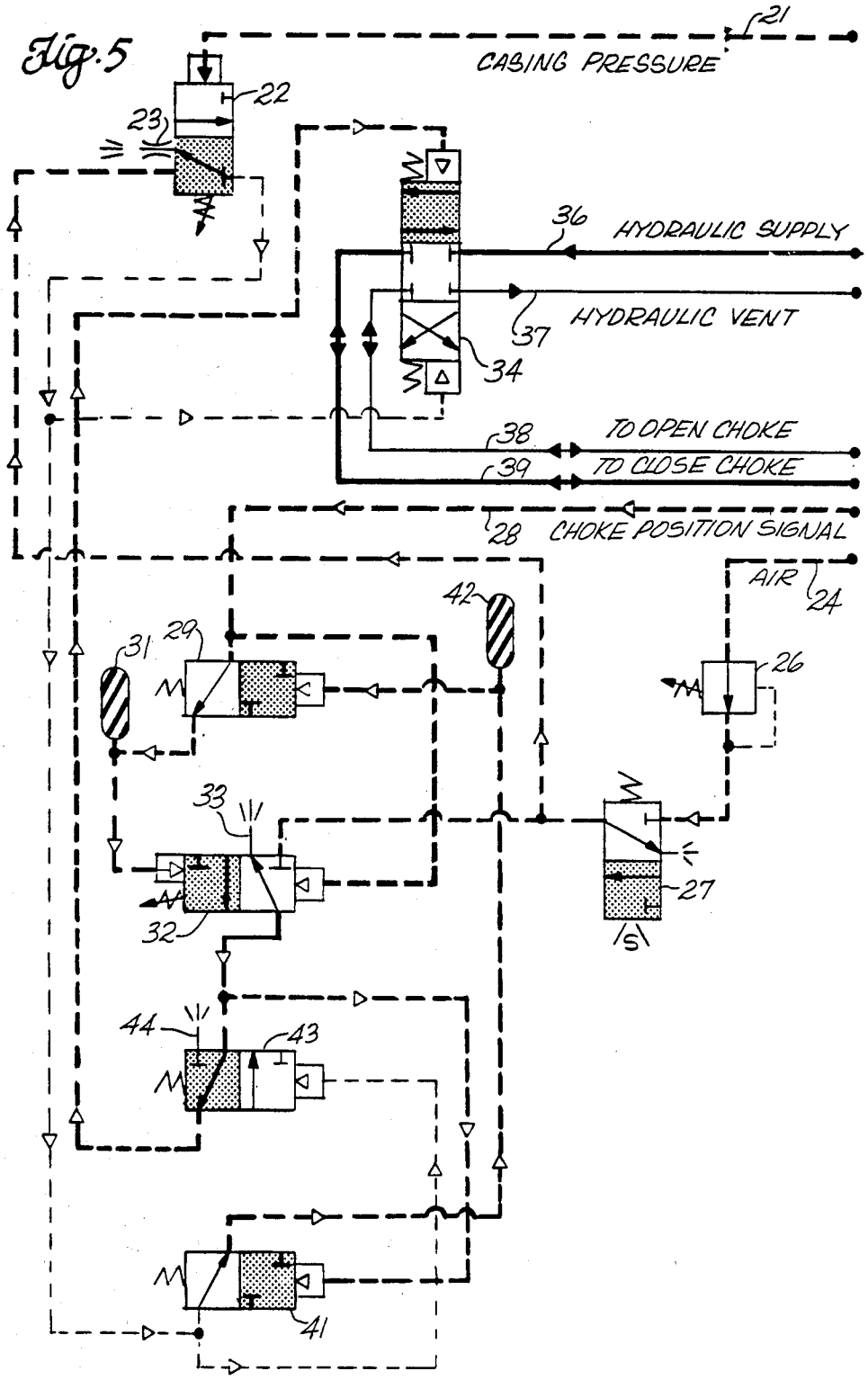
Figure 6:
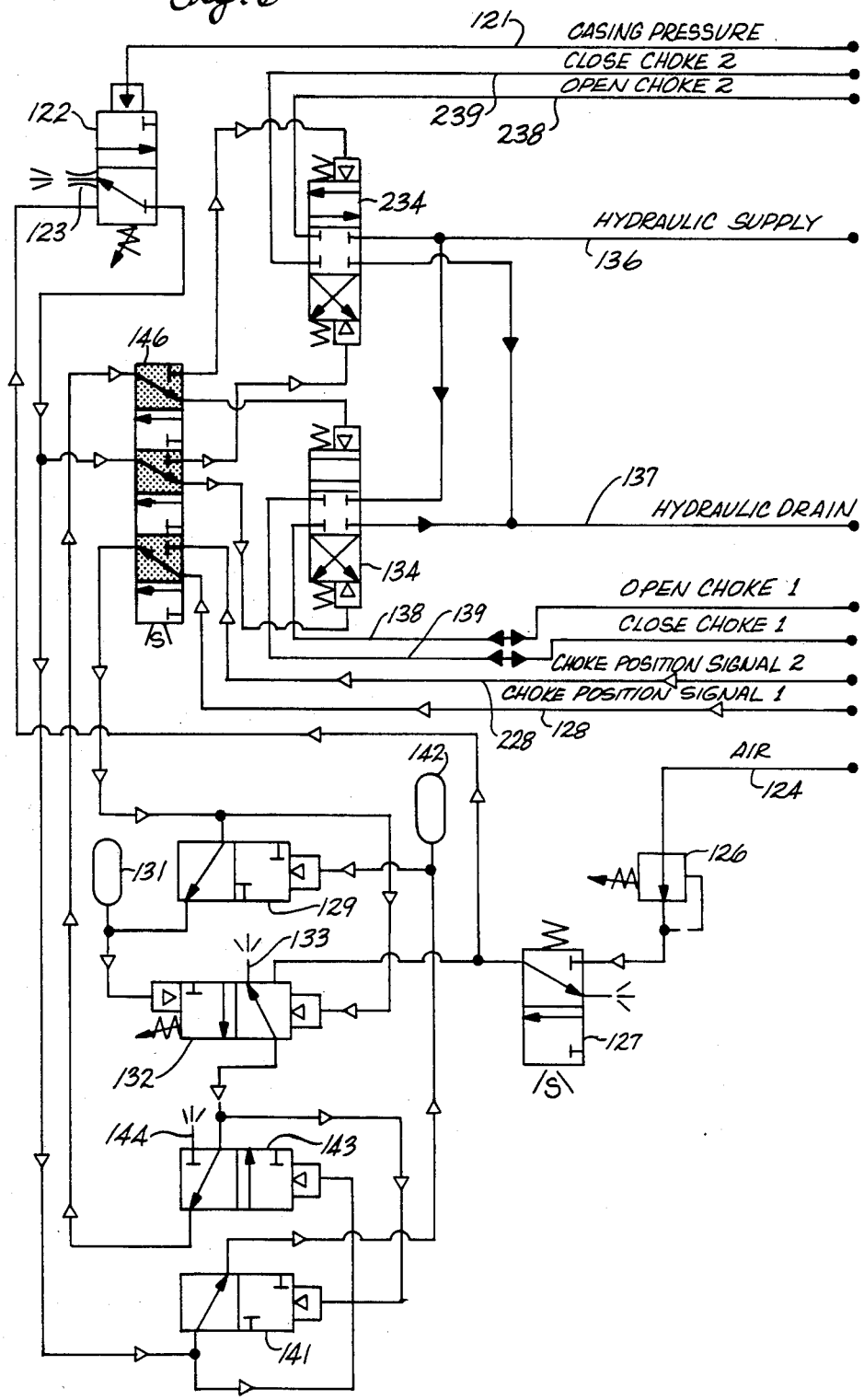

These and other features and advantages of the present invention will be appreciated as the same becomes better understood by reference to the following detailed description when considered in connection with the accompanying drawings wherein:

FIG. 1 illustrates schematically an oil well in which a pressure limiting system is employed;

FIGS. 2 to 5 are schematic diagrams of the pressure limiting system in which FIG. 2 is modified to indicate the system condition when armed and the well casing pressure is below the limit, FIG. 3 is modified to indicate the system condition when the maximum allowable casing pressure is exceeded, FIG. 4 is modified to indicate the system condition as the well choke is opened and the casing pressure still exceeds the maximum allowable, and FIG. 5 is modified to indicate the system condition when the casing pressure is below the maximum allowable and the choke is closing to its original position; and wherein FIG. 6 is a schematic diagram of a pressure limiting system for operating either of two chokes.

DESCRIPTION

FIG. 1 illustrates in highly schematic form an oil well 10 being drilled. At least a portion of the depth of the well is closed by a steel casing 11 cemented in the well for containing pressure. The well is drilled by a conventional drill bit 12 indicated schematically at the bottom of a drill pipe string 13. During drilling high pressure mud is pumped down the drill string for a variety of reasons, including removal of drilling chips from the bottom of the well. The mud returns to the ground surface through the annulus between the drill string 13 and the casing 11. As the mud leaves the casing at the well head it passes through a choke 14 which has a small orifice with high pressure drop so that mud can be discharged at low pressure as compared with the high pressure in the casing.

Such a choke is opened or closed to a given setting by a hydraulic actuator 16. The actuator is controlled by a pressure control system 17 which includes a variety of standard control functions which are neither described nor illustrated herein since not required for an understanding of this invention. The hydraulic actuator includes means for indicating the position of the choke to a remote location so that the choke setting can be measured and controlled. In a preferred embodiment this comprises a regulator that provides a pneumatic signal, the pressure of which indicates the choke position.

In practice of this invention, a feature of the control system is a system for limiting the maximum allowable pressure in the casing to avoid damage. Pressure in the casing may increase if chips from drilling partially plug the choke. If that should occur the pressure limiting system opens the choke to relieve pressure and permit particles to pass through the choke opening. Once the casing pressure has decreased below the maximum allowable pressure, the choke is reset to its original position.

FIGS. 2 to 5 illustrate in schematic diagrams a system for limiting the maximum pressure allowable in the casing. These diagrams are drawn using standard ANS graphic symbols for fluid power diagrams as set forth in American National Standard ANS Y 32.10.

In these diagrams solid lines are used for indicating the working tubes for hydraulic fluid for choke actuation. Dashed lines are used to indicate pneumatic control tubes and the tube transmitting casing pressure to the system for actuation of the system. Solid arrowheads indicate direction of fluid flow in hydraulic tubes. Open arrowheads indicate direction of fluid flow in pneumatic tubes.

A variety of multiple position logic valves are shown in the drawings using standard symbols. For example, a pilot controlled valve is shown with a smaller square containing an arrowhead at one end to indicate the pilot operator. A zig-zag at an end of the valve indicates spring loading, and a diagonal arrow through the spring indicates adjustability.

In each of FIGS. 2 to 5 the active position of each valve is indicated by stippling within the appropriate segment of the valve. During operation of the system various of the fluid tubes are charged with pressure at various stages of the control cycle. To indicate this in the drawings wider line widths are used to indicate tubes that are charged while uncharged tubes have narrower line widths. There is a single description of the components in FIGS. 2 to 5 with the same reference numerals used in each of these figures. Operation of the components are described by reference to successive drawings.

FIG. 6 is a system quite similar to the system illustrated in FIGS. 2 to 5 except that it can be used to operate either of two chokes. For this reason the reference numerals used to refer to components in FIG. 6 are the same as those used in FIGS. 2 to 5, plus 100; that is, the counterpart in FIG. 6 of a part identified as 20 in FIGS. 2 to 5 would be identified as 120 in FIG. 6.

The pressure in an oil well casing is determined in the manifold upstream from the choke and reaches the pressure limiting system by way of a fluid line 21. The casing pressure is applied directly to the operating pilot of a pilot operated hydraulic-pneumatic converter valve 22. A Bourdon tube sensor can be used for direct reading of the casing pressure to provide accuracy in the pressure control. The converter is spring biased to normally be in the closed position illustrated in FIG. 2. The bias is adjustable for setting the maximum allowable pressure desired in the casing. In an exemplary embodiment the pressure setting can be varied from 0 up to 20,000 psig. In the closed position illustrated in FIG. 2 the converter valve 22 vents pressure from the pressure limiting system through a vent 23 so that the system is not active.

As illustrated in FIG. 2, the pressure limiting system is armed by pneumatic pressure from an air line 24 using ordinary "shop air" at the pressures typically employed well drilling, normally about 100 psig. For use in the pressure limiting system air pressure is adjusted to a nominal 50 psig. by a regulator 26. The system is armed by closing a manual valve 27. This applies pneumatic pressure to the inlet of the converter valve 22.

When the choke is in use it is set to an appropriate opening for obtaining the drilling mud flow rate and pressure drop specified by the driller. This set position of the choke is monitored by a pneumatic system associated with the hydraulic actuator, which generates a choke position signal proportional to the opening of the choke. In an exemplary embodiment the choke position signal may range from 3 to 15 psig. with pressure increasing as the choke is closed.

The choke position signal is transmitted to the pressure limiting system by a line 28 connected to the inlet of a memory retention or latching valve 29. The memory latching valve is spring biased to be open when the system is armed as illustrated in FIG. 2. The choke position signal is therefore also applied to a signal memory accumulator 31. When the memory latching valve is open the choke position pressure signal is applied to both ends of a pneumatic comparator 32. The comparator is spring biased so that when the system is armed and pressures on both sides of the comparator are equal, the comparator valve is closed and a portion of the system is vented by way of a vent 33. The spring bias of the comparater is adjustable so that the resetting sensitivity can be selected.

To assure accuracy and reliability in the system tight sealing elastomeric logic valves are preferred for the memory latching valve and other valves used in the system. It is also desirable to employ a lubricator for at least the memory portion of the system to assure long leak free life of the system.

FIG. 3 illustrates the system condition when the casing pressure in the line 21 exceeds the set point or maximum allowable pressure at the converter valve 22. This causes the converter valve to open, as illustrated by the stippling in the upper square of the symbol in FIG. 3. Opening of the comparator valve applies the system operating air from the regulator 26 to commence remedial action. The pneumatic pressure is applied to the pilot operator at one end of a pilot controlled three-way valve 34. The three-way valve is connected to a supply of pressurized hydraulic fluid 36 at a nominal 1,500 psig. The valve is also connected to a hydraulic drain 37 that returns hydraulic fluid to a hydraulic pump as may be required during operation of the system. The pneumatic pressure on the three-way valve opens the valve so that hydraulic pressure is applied to a line 38 that goes to the choke actuator for opening the choke. Concurrently a hydraulic line 39 connected to the closing side of the choke actuator is vented to the hydraulic drain. Thus as soon as the casing pressure exceeds the allowable maximum, the three-way valve opens and the choke begins to open.

At the same time the pneumatic pressure applied to the system through the comparator 22 is applied to the inlet of an isolation latching valve 41. The isolation latching valve is spring biased open so that the air pressure in the limiting system is also applied to an isolation accumulator 42. The air pressure also switches a reset valve 43 which assures that the pilot operator that would switch the three-way valve to the choke closing position is vented by way of a vent 44. Energizing the choke opening pilot operator of the three-way valve and venting the choke closing pilot operator assures that the choke opens promptly when the casing pressure exceeds the allowable maximum.

When casing pressure exceeds the allowable maximum, pneumatic pressure is also applied to the memory latching valve 29. This closes its ports so that the choke position signal is no longer applied to the signal memory accumulator 31. The pressure in the signal memory accumulator remains at its set level since this portion of the system is now isolated. This serves as a memory of the set point of the choke position so that when the casing pressure again returns below its maximum, the choke can be reset to its original position. This is significant since, as soon as the choke begins to open, the pressure representative of the choke position decreases.

This decrease in pressure unbalances the pneumatic comparator 32, switching it to the open position illustrated in FIG. 4. This opening of the valve 32 at the pressure comparator applies line pressure to the isolation latching valve 41, thereby closing it and isolating the isolation accumulator 42. The magnitude of the pressure trapped in the isolation accumulator is not critical so long as it is adequate to keep the memory latching valve 29 in its closed position. This assures that the set point of the choke can be remembered as the choke position signal decreases and the casing pressure decreases.

As the casing pressure decreases due to opening of the choke, it soon reaches a magnitude less than the allowable maximum set at the converter 22. This causes the converter to switch back to its closed position as illustrated in FIG. 5. Closing of the converter vents pressure from the pilot operator that switches the three-way valve to the choke open position. It also relieves pressure on the pilot operator of the reset valve 43, which switches to the open position. The pneumatic comparator 32 remains open since the memory pressure in the signal memory accumulator 31 exceeds the choke position signal pressure. With these two valves open, pneumatic line pressure is applied to the pilot operator that switches the three-way valve 34 to apply hydraulic pressure to the choke closing line 39 and vent the choke opening line 38 to the hydraulic drain, thereby causing the choke to commence closing. The isolation latching valve 41 remains closed thereby maintaining pressure in the isolation accumulator 42 to keep the memory latching valve 29 in its closed position.

Closing of the choke when the system has switched to the position illustrated in FIG. 5 causes the choke position signal 28 to increase as the choke approaches its original position. The choke position signal is applied to the pneumatic comparator 34 and when the pressure equals that stored in the signal memory accumulator 31, the comparator switches back to its closed position as illustrated in FIG. 2. This vents the air line to the pilot operator on the three-way valve, causing the valve to return to its central position with hydraulic pressure applied to neither the choke opening line 38 nor choke closing line 39. The choke is thus returned to its original position.

In addition, the pilot operator on the isolation latching valve 41 is also vented, permitting that valve to reopen. This vents pressure from the isolation accumulator 42 through the isolation latching valve and converter to the vent 23. Release of pressure in the isolation accumulator permits the memory latching valve 29 to switch back to its open position so that the choke position signal is again applied to the signal memory accumulator 31. This rearms the pressure limiting system to be prepared to follow the same cycle in the event casing pressure should again exceed its allowable maximum.

FIG. 6 illustrates a variation in the pressure limiting system of the type illustrated in FIGS. 2 to 5. This system differs only in being able to control either of two chokes in a drilling system. A choke in a drilling system is subject to appreciable wear and may need to be isolated for replacement of worn trim. If this should occur it is desirable to have a second choke in parallel so that drilling operations may continue as the choke trim is replaced. FIG. 6 illustrates a pressure limiting system for use with either of two such chokes.

As mentioned above, each of the components in the pressure limiting system illustrated in FIG. 6 having a counterpart in FIGS. 2 to 5 is numbered similarly in the drawing, except that each reference numeral is increased by 100. In this embodiment the choke position signal 128 from a first choke is connected to a manual selector valve 146. The selector valve is illustrated in the position that connects the choke position signal from the first choke to the pressure limiting system. With the selector valve in this position pneumatic pressures, if any, are applied to a three-way valve 134 for opening or closing the first choke in exactly the same manner hereinabove described and illustrated.

The selector valve 146 can be switched to an alternate position when the first choke is not in use. When switched the choke position signal 228 from a second choke is connected to the pressure limiting system and the pneumatic pressures, if any, resulting from operation of the pressure limiting system are applied to the pilot operators of a second three-way valve 234 for applying hydraulic pressure as required for opening or closing the second choke in exactly the same manner as hereinabove described and illustrated.

The arrangement provided for limiting pressure by control of either of two chokes as described and illustrated in FIG. 6 is advantageous in that one of the chokes can be operated manually while the other is connected to the automatic system, regardless of whether the system is armed or has opened the one choke in response to a pressure increase in the well.

Although described in a preferred embodiment, it will be apparent that many modifications and variations in practice of this invention are possible. For example, instead of employing a three-way valve connected to the hydraulic actuator for a choke, separate valves can be used for opening and closing the choke. Similarly, separate accumulators may not be needed for storing the signal indicative of choke position and the pressure that secures the memory latching valve in its closed position when the tubes in which these pressures occur are large enough that any leakage or volume change due to displacement of pilot operators is trivial to proper operation of the pressure limiting system. By selecting a large accumulator, the memory storage period can be long without decreasing accuracy of the choke set point. It is therefore to be understood that within the scope of the following claims, this invention may be practiced otherwise than as specifically described.

What is claimed is:

1. A pneumatic pressure limiting system for a hydraulically actuated drilling choke having a pneumatic pressure signal indicative of the choke position comprising:

means responsive to casing pressure for selectively activating the pressure limiting system by applying pneumatic pressure when the casing pressure exceeds a maximum allowable pressure;

a memory accumulator connected to the source of the pressure signal indicative of choke position;

a pilot controlled memory latching valve operable upon activation of the system for temporarily isolating the memory accumulator for storing the pressure signal indicative of choke position before activation of the pressure limiting system; and pneumatic accumulator means connected to the pilot operator of the memory latching valve for maintaining isolation of the memory accumulator until the casing pressure decreases below the maximum allowable pressure.

2. A pressure limiting system as recited in claim 1 wherein the means responsive to casing pressure for activating the system comprises an adjustable pilot controlled converter valve having its pilot operator connected to the casing for opening the valve when pressure in the casing exceeds a maximum allowable pressure.

3. A pressure limiting system as recited in claim 1 comprising means for isolating the pneumatic accumulator when the pneumatic pressure signal indicative of choke position decreases below the pressure indicative of choke position before activation of the system.

4. A pressure limiting system for a drilling choke comprising:

a hydraulic actuator for a drilling choke;

an adjustable pilot controlled converter valve having its pilot operator connected to a choke manifold for opening the valve when the pressure in the choke manifold exceeds a maximum allowable pressure;

means for applying a pneumatic pressure to the inlet of the converter valve; and a pneumatic control system connected to the outlet of the converter valve for applying hydraulic pressure to the actuator for opening the choke when the converter valve is opened and for applying hydraulic pressure to the actuator for closing the choke to its original set point when the converter valve is closed, and comprising means for storing a pneumatic pressure signal indicative of choke position prior to opening of the converter valve and pneumatic means for maintaining storage of the signal until the choke is returned to its original set point position before the converter valve was opened.

5. A pressure limiting system as recited in claim 4 wherein the means for maintaining storage of the stored signal comprises:

a pneumatic accumulator;

a memory latching valve connected to the accumulator for isolating the memory storage means in response to pressure in the accumulator; and an isolation valve for isolating the pneumatic accumulator upon decreasing of the pressure signal indicative of choke position for retaining pressure in the accumulator.

6. A pressure limiting system as recited in claim 5 comprising means for closing the choke when the converter valve is closed while maintaining isolation of the pneumatic accumulator and the memory storage means.

7. A pressure limiting system as recited in claim 6 comprising means for venting pneumatic pressure from the system when the pressure signal indicative of choke position equals the stored signal for retaining the choke in its original set point position.

8. A pressure limiting system for a drilling choke comprising:

a pilot controlled three-way valve for applying hydraulic pressure to open a choke in a first valve position and to close the choke in a second valve position;

means for generating a pressure signal indicative of the position of the choke;

a pneumatic comparator having one side connected to the choke position indicating pressure means;

a signal memory pneumatic accumulator connected to the other side of the pneumatic comparator;

a memory latching valve for alternately connecting the signal memory accumulator to the choke position indicating pressure means or isolating the signal memory accumulator from the choke position indicating pressure means;

a pneumatic isolation accumulator connected to the memory latching valve for selectively isolating the signal memory accumulator;

a pilot controlled choke reset valve having an inlet connected to the pneumatic comparator and an outlet connected to the three-way valve for biasing the three-way valve toward the choke closing position when pressure in the signal memory pneumatic accumulator is higher than the choke position indicating pressure;

a hydraulic-pneumatic converter for comparing the pressure in the casing of a well with a maximum allowable pressure set point and generating a pneumatic pressure in the pressure limiting system when the maximum allowable pressure set point is exceeded, the source of pneumatic pressure being connected to the three-way valve for biasing the three-way valve toward the choke open position and to the pilot operator of the choke reset valve to prevent choke closing; and a pilot controlled isolation latching valve for alternately connecting the isolation accumulator to the source of pneumatic pressure or isolating the isolation accumulator from the source of pneumatic pressure, the pilot operator of the isolation latching valve being connected to an outlet of the pneumatic comparator for isolating the isolation accumulator when pressure in the signal memory accumulator is higher than the choke position indicating pressure.

* * * * *